US010189288B1

(12) United States Patent
Moreira et al.

(10) Patent No.: US 10,189,288 B1
(45) Date of Patent: Jan. 29, 2019

(54) REJECTED MEDIA UNIT STORAGE FOR MEDIA PROCESSING DEVICES

(71) Applicant: ZIH CORP., Lincolnshire, IL (US)

(72) Inventors: Joseph D. Moreira, Barrington, RI (US); Angel B. Rosales, Port Hueneme, CA (US); Steve Ting Kei Chow, Monterey Park, CA (US); Myung S. Jun, Oak Park, CA (US)

(73) Assignee: ZIH Corp., Lincolnshire, IL (US)

( * ) Notice: Subject to any disclaimer, the term of this patent is extended or adjusted under 35 U.S.C. 154(b) by 0 days.

(21) Appl. No.: 15/643,925

(22) Filed: Jul. 7, 2017

(51) Int. Cl.
*B41J 15/04* (2006.01)

(52) U.S. Cl.
CPC ..... *B41J 15/044* (2013.01)

(58) Field of Classification Search
CPC ..... B41J 11/02; B41J 11/053; B41J 11/057; B41J 11/06; B41J 11/08; B41J 11/10; B41J 11/13; B41J 15/044; B41J 11/04
See application file for complete search history.

(56) References Cited

U.S. PATENT DOCUMENTS

| | | | | |
|---|---|---|---|---|
| 1,515,986 | A | 11/1924 | Wright et al. | |
| 3,636,316 | A | 1/1972 | Suzuki et al. | |
| 4,281,244 | A | 7/1981 | Murata et al. | |
| 4,971,310 | A | 11/1990 | Motegi et al. | |
| 5,061,022 | A | 10/1991 | Meriwether | |
| 5,768,143 | A * | 6/1998 | Fujimoto | G06Q 20/341 235/375 |
| 6,600,167 | B2 | 7/2003 | Sano | |
| D527,044 | S | 8/2006 | Harden et al. | |
| 7,328,897 | B2 | 2/2008 | Bryant et al. | |
| 7,416,179 | B2 | 8/2008 | Jones et al. | |
| 7,433,614 | B2 | 10/2008 | Suzuki | |
| 8,387,975 | B2 | 3/2013 | Suzuki | |
| 2003/0090052 | A1 | 5/2003 | Hsiao et al. | |
| 2004/0109715 | A1 | 6/2004 | Meier et al. | |
| 2005/0078973 | A1 | 4/2005 | Suzuki | |
| 2005/0242488 | A1 | 11/2005 | Pelletier et al. | |
| 2006/0091331 | A1 | 5/2006 | Tanamachi | |
| 2007/0228647 | A1 | 10/2007 | Hara | |

(Continued)

FOREIGN PATENT DOCUMENTS

| | | | |
|---|---|---|---|
| EP | 385417 | A2 | 9/1990 |
| EP | 623894 | A1 | 11/1994 |

(Continued)

OTHER PUBLICATIONS

Zebra P630i/P640i Card Printer User's Manual, Manual, 2006, pp. 8, 26-28, 980541-003 Rev. A, ZIH Corp.
Zebra P330i/330M Card Printer User's Manual, Manual, 2004/2005, pp. 26 and 27, 980459-001 Rev. C, ZIH Corp.
Printing and Encoding Solutions, Fargo HDP8500 Industrial Card Printer/Encoder, Brochure, 2014, p. 3, Fargo.

(Continued)

*Primary Examiner* — Kristal Feggins

(57) ABSTRACT

A media processing device includes: a housing having an opening providing access to a cassette removably supported within the housing; a media unit holder configured to receive a rejected media unit driven between the opening and a body of the cassette along a media reject path; the media unit holder including: a deck having a support surface between a body of the cassette and the opening, the support surface facing the opening; the deck configured to receive the rejected media unit on the support surface for removal of the rejected media unit via the opening.

15 Claims, 7 Drawing Sheets

(56) References Cited

U.S. PATENT DOCUMENTS

| | | | | |
|---|---|---|---|---|
| 2010/0289845 | A1 | 11/2010 | Conway et al. | |
| 2011/0049788 | A1 | 3/2011 | Suzuki et al. | |
| 2011/0056415 | A1* | 3/2011 | Moog ..... | G07D 11/0006 109/45 |
| 2011/0123307 | A1 | 5/2011 | Pillard | |
| 2011/0217109 | A1 | 9/2011 | Cronin et al. | |
| 2012/0181741 | A1 | 7/2012 | Suzuki | |
| 2012/0181744 | A1 | 7/2012 | Suzuki | |
| 2013/0140759 | A1 | 6/2013 | Kuo | |
| 2013/0334771 | A1 | 12/2013 | Igarashi | |
| 2014/0374986 | A1 | 12/2014 | Takada | |
| 2015/0028532 | A1 | 1/2015 | Takahashi | |
| 2016/0229207 | A1 | 8/2016 | Perry et al. | |

FOREIGN PATENT DOCUMENTS

| | | | |
|---|---|---|---|
| EP | 1510484 | A1 | 3/2005 |
| JP | 200584439 | A | 3/2005 |
| WO | 2009/136129 | A1 | 11/2009 |

OTHER PUBLICATIONS

Polaroid XPS Card Printer, Installation and User Guide, Jun. 2011, entire document, Part No. 539957-020 Rev. A.
Evolis Tattoo 2: User's Guide, Sep. 2007, entire document, Evolis Card Printer.
International Search Report and Written Opinion for International Patent Application No. PCT/US2016/017996 dated Jun. 1, 2016.
Evolis Primacy User Guide, Manual, Sep. 2016, entire document, Ref# KU-PRM1-C37-ENC Rev. C6, Evolis.
NBS Technologies Card Printer, Javelin DNA User Guide Manual, Manual, 2015, entire document.
U.S. Appl. No. 14/670,961, filed Mar. 27, 2015.
U.S. Appl. No. 15/807,043, filed Nov. 8, 2017.
U.S. Appl. No. 15/951,817, filed Apr. 12, 2018.
U.S. Appl. No. 15/643,966, filed Jul. 7, 2017.
U.S. Appl. No. 15/644,017, filed Jul. 7, 2017.
U.S. Appl. No. 29/606,497, filed Jun. 5, 2017.
U.S. Appl. No. 29/609,961, filed Jul. 7, 2017.
U.S. Appl. No. 15/644,048, filed Jul. 7, 2017.

* cited by examiner

REJECTED MEDIA UNIT STORAGE FOR MEDIA PROCESSING DEVICES

BACKGROUND

Media processing devices configured to process discrete media units, such as card printers configured to print identity cards, are typically also configured to detect various defects in the cards during the printing process. The handling of defective media units may lead to increased complexity or interrupted operation of the media processing device.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
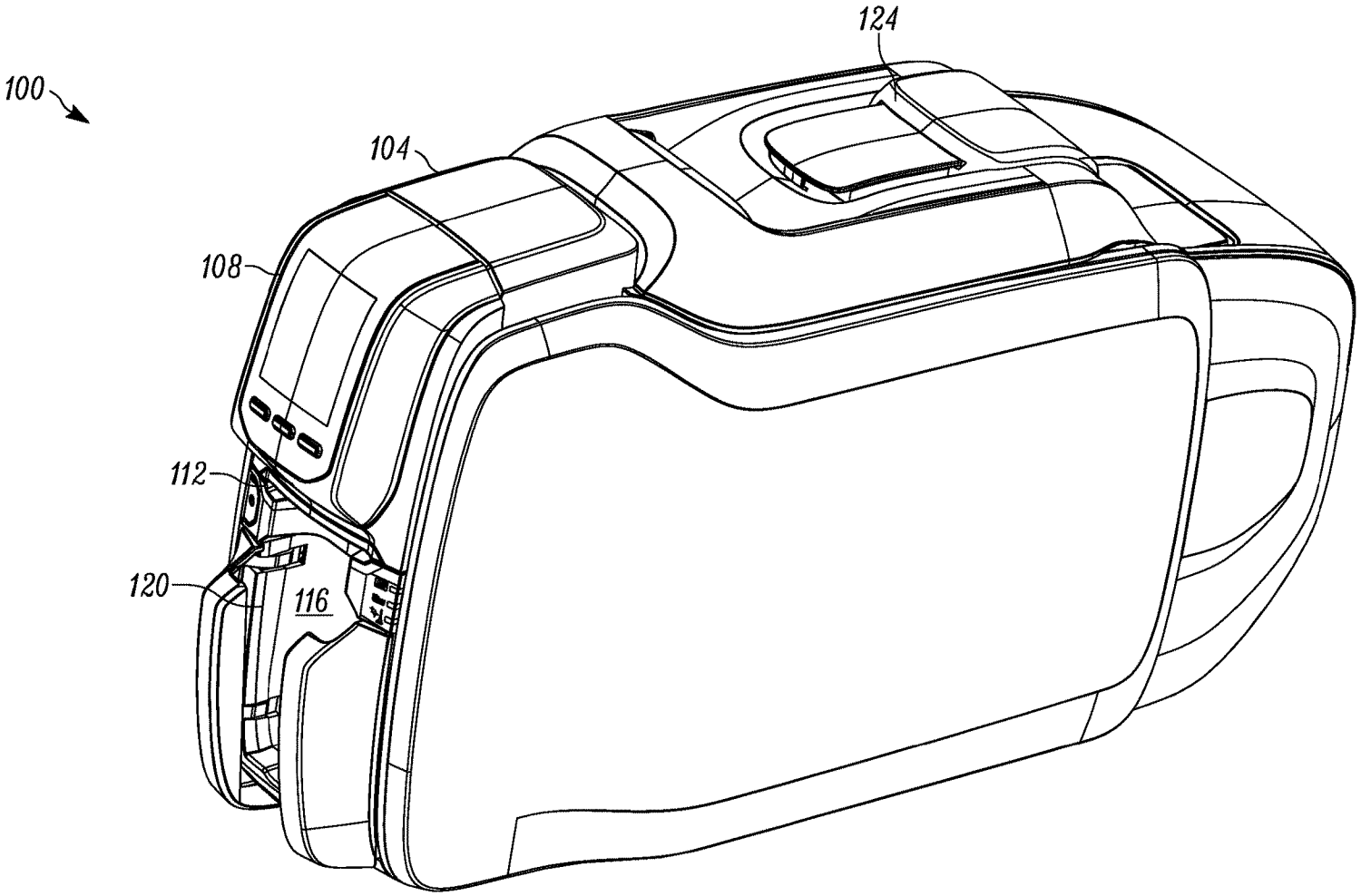
FIG. 1 depicts an example media processing device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding embodiments of the apparatus and methods disclosed herein so as not to obscure the disclosure with details that will be readily apparent to those of ordinary skill in the art having the benefit of the description herein.

DETAILED DESCRIPTION

Some media processing devices are configured to process discrete media units, such as identity cards (e.g., driver's licenses or employee badges). Some examples disclosed herein are described using the term "cards." However, cards are example discrete media units and example methods and apparatus disclosed herein are applicable to any suitable type of discrete media unit(s).

Media processing devices configured to process discrete media units, such as identity cards, are typically configured to detect certain defects in the cards during processing. For example, imaging sensors may be employed to detect defects in indicia applied to a card at a print head, or to detect physical defects in the shape of the card. Further, such cards may include data storage devices, such as magnetic strips, RFID or NFC chips, or the like. Processing hardware configured to read and/or write data from or to such chips can also be configured to detect errors in the read and write processes. Typically, defective cards are not deployed for use, but are instead discarded.

When a defective card is detected, the defective card may be redirected to a rejected card storage area distinct from the output for non-defective cards. Such separate areas, however, may require emptying separately from the regular output of the media processing device. Operators may forget to empty such reject areas, resulting in overfilling of the reject area and subsequent malfunction of the media processing device.

Example methods and apparatus disclosed herein provide media processing devices with an easily accessible reject area by, for example, positioning rejected cards in a location viewable when replacing a ribbon cassette. Further, example methods and apparatus disclosed herein prevent malfunctions related to failure to empty rejected cards by, for example, requiring removal of rejected cards when replacing a ribbon cassette. Further, example methods and apparatus disclosed herein provide secure access to rejected cards by, for example, positioning rejected cards behind a lockable panel or door. Further, example methods and apparatus disclosed herein avoid rejected cards from mixing with non-rejected cards by, for example, providing a reject area separate from an output of non-rejected cards.

Some example apparatus disclosed herein are directed to a media processing device comprising: a housing having an opening providing access to a cassette removably supported within the housing; a media unit holder configured to receive a rejected media unit driven between the opening and a body of the cassette along a media reject path; the media unit holder including: a deck having a support surface between a body of the cassette and the opening, the support surface facing the opening; the deck configured to receive the rejected media unit on the support surface for removal of the rejected media unit via the opening.

FIG. 1 depicts an example media processing device 100 constructed in accordance with the teachings of this disclosure. The media processing device 100 includes a housing 104 defined by a plurality of panels. The media processing device 100 stores a supply of discrete media units, such as cards (e.g. identity cards) in an unprocessed media source. In this example, the unprocessed media source is an input hopper (not shown) within the housing 104 and accessible from the exterior of the media processing device 100 via an input hopper door 108. The media processing device 100 also includes an auxiliary input slot 112 for insertion of single media units into the input hopper. The media processing device 100 generates indicia on a media unit from the input hopper before dispensing the media unit into a processed media output. In this example, the processed media output is an output hopper 116 accessible via an output opening 120. As will be discussed below, the indicia applied to the media units by the media processing device 100 is sourced from a cassette (e.g. a ribbon cassette) supported within the housing 104 and accessible from the exterior of the media processing device 100 via a cassette access door 124. In some examples, the access door 124 includes a lock to prevent unauthorized access to the interior of the media processing device 100 and, as described below, rejected media units. Notably, the output opening 120 associated with processed media (i.e., non-rejected cards) is separate from the reject area described in detail below.

Figure 2:
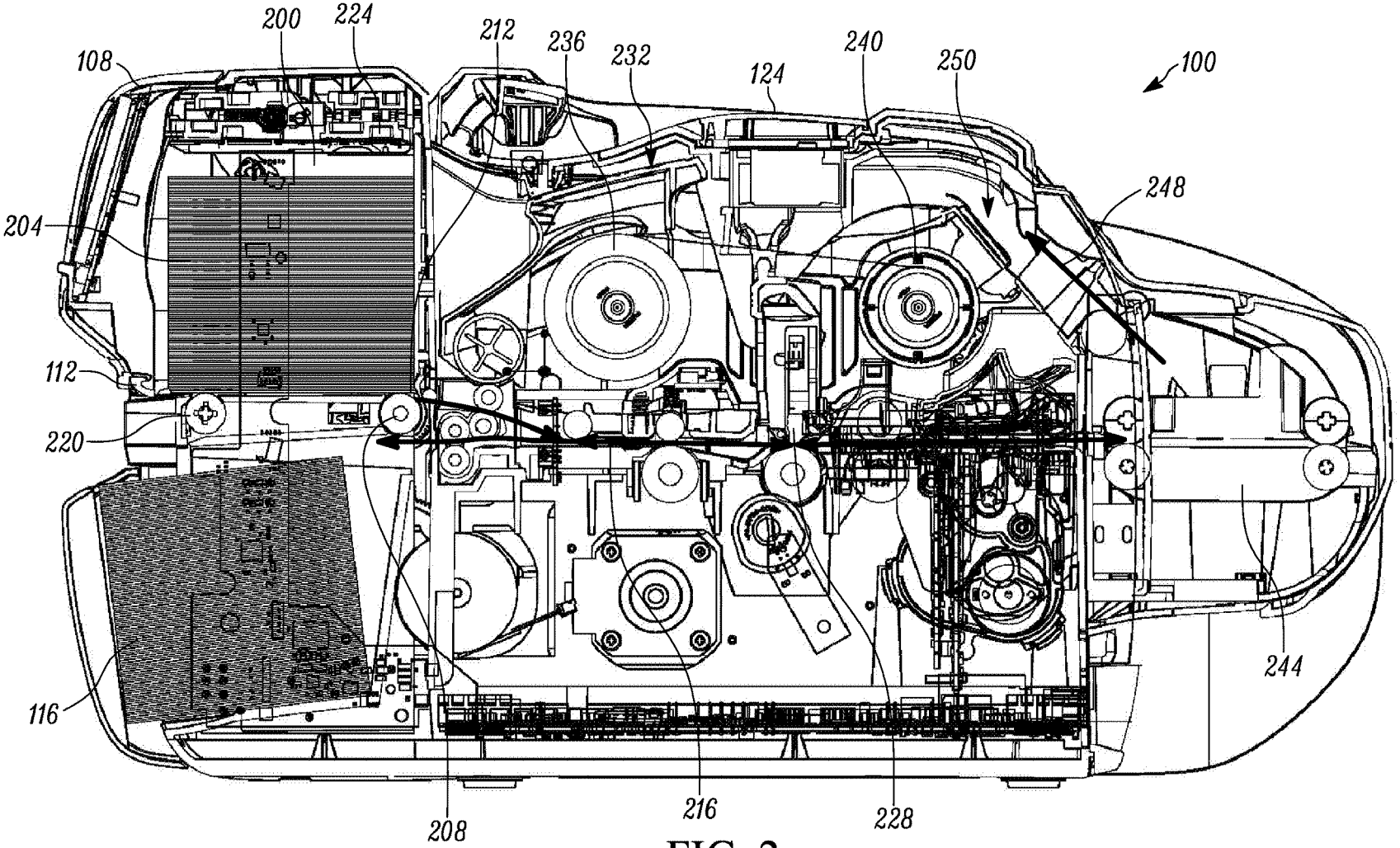
FIG. 2 depicts a cross-sectional view of the media processing device of FIG. 1.

Turning to FIG. 2, a cross-sectional view of the example media processing device 100 of FIG. 1 is depicted. As seen in FIG. 2, the media processing device 100 includes, within the housing 104, an unprocessed media input in the form of an input hopper 200. The input hopper 200 is configured to store a plurality of discrete media units 204, such as identity cards, in a substantially horizontal stack. The input hopper 200 may contain media units 204 of a variety of thicknesses. For example, each media unit 204 has a thickness of between 0.2 mm and 1.0 mm. Typically, the entire supply of media units 204 in the input hopper 200 at a given time have the same thickness. However, in some examples the media processing device 100 is also configured to process a set of media units 204 having a plurality of different thicknesses.

A pick roller 208 is disposed at an outlet 212 of the input hopper 200, and is configured to dispense a single media unit 204 from the input hopper 200 to a media transport assembly configured to guide the media unit 204 along a media processing path 216. The media processing device 100 also includes an input roller 220 at the slot 112, configured to drive a single media unit fed into the slot 112 underneath the stack of media units 204 already present (if any) in the input hopper. The single media unit fed into the slot 112 is then dispensed from the input hopper 200 for travel along the media processing path 216. In other words, the media processing device 100 is configured to process media units retrieved from the stack in the input hopper 200, as well as single-feed media units received via the input slot 112.

The input hopper 200 also contains a biasing assembly 224 disposed above the stack of media units 204. The pick roller 208 dispenses the bottom media unit from the stack of media units 204 by frictionally engaging with the bottom media unit 204. As will be apparent, if insufficient force is exerted by the bottom media unit on the pick roller 208, the frictional engagement between the pick roller 208 and the media unit may be too weak for the pick roller 208 to dispense the media unit. When the input hopper 200 is full, the weight of the stack of media units 204 alone may apply sufficient force for engagement between the bottom media unit and the pick roller 208. The biasing assembly 224 is configured to apply a progressively greater force to the top of the stack of media units 204 as the stack shrinks in size, thus maintaining a substantially constant force on the bottom media unit. The biasing assembly 224, in the present example, is implemented as a Sarrus linkage biased towards an open position in which the biasing assembly 224 applies a force on the media units 204 (the linkage is shown in a closed, or retracted, position in FIG. 2) by one or more biasing elements, such as a combination of coil springs.

The media transport assembly includes a plurality of rollers and guide surfaces. The media processing path 216, as seen in FIG. 2, extends from the input hopper 200 to a processing head 228, such as a printhead configured to apply indicia to the media unit 204 by transferring ink to the media unit 204. In this example, the media processing device 100 is a thermal transfer printer, and the printhead 228 is supplied with ink from a cassette 232 removably supported within the housing 104. The housing 104 includes an opening (not shown in FIG. 2) permitting access to the cassette 232. The above-mentioned cassette access door 124 has a closed position (shown in FIG. 2) for obstructing the opening to prevent access to the cassette 232, and an open position for permitting placement and removal of the cassette 232 into and out of the media processing device 100.

During printing operations, an ink ribbon (not shown) travels from a supply roller 236 of the cassette 232 to the printhead 228, and then to a take-up roller 240 of the cassette 232. As the ink ribbon and the media unit 204 pass the printhead 228, the ink ribbon is in contact with the media unit 204. To generate the above-mentioned indicia, certain elements (e.g., printhead dots) of the printhead 228 are selectively energized (e.g., heated) according to machine-readable instructions (e.g., print line data or a bitmap). When energized, the elements of the printhead 228 apply energy (e.g., heat) to the ribbon to transfer ink to specific portions of the media unit 204.

In some examples, processing of the media unit 204 also includes encoding data in an integrated circuit, such as a radio frequency identification (RFID) tag, magnetic strip, or combination thereof, embedded in the media unit 204. Such processing may occur at the printhead 228 mentioned above, or at a distinct secondary processing head upstream or downstream of the printhead 228 along the media processing path 216.

Having traversed the printhead 228, the media unit 204 is transported along the media processing path 216 to the output hopper 116. In the present example, prior to arriving at the output hopper, however, the media unit is transported to a media unit redirector 244 controllable to reverse, or flip, the media unit 204 by receiving the media unit 204, rotating by about 180 degrees, and expelling the media unit 204. Accordingly, the media transport assembly is configured to operate in two opposite directions along at least a portion of the media processing path 216 (illustrated in double lines). Specifically, the media processing path 216 proceeds in a return direction (as opposed to an outbound direction from the input hopper 200 to the printhead 228 and the redirector 244, described above) from the redirector 244 to the printhead 228. As a result of the media unit 204 having been flipped at the redirector 244, on the return pass of the printhead 228 an opposite side of the media unit 204 is exposed to the printhead 228 than on the outbound pass of the printhead 228. The media processing device 100, in other words, is capable of applying indicia to both sides of the media unit 204, before the media unit 204 is transported along the remainder of the media processing path 216 to the output hopper 116.

A media unit 204 travelling along the media processing path 216 may also be redirected from the media processing path 216 to an auxiliary processing path 248, also referred to as a media reject path. In the illustrated example, the redirector 244 is controllable, for example responsive to a detection of misaligned indicia applied at the printhead 228, a failed data writing operation to an embedded circuit in the media unit 204 or other defect, to rotate to a reject position at an angle other than 180 degrees from the resting position shown in FIG. 2. Having rotated to the reject position, the redirector 244 is configured to expel the media unit 204, which is transported along the reject path 248 to a media unit holder 250 that defines a storage area for rejected media units. As will be described in greater detail below, the media unit holder 250 is structured and positioned within the housing 104 to facilitate the removal of any rejected media units when the door 124 is opened to replace the cassette 232 (e.g. upon depletion of the ink supply of the cassette 232).

Figure 3:
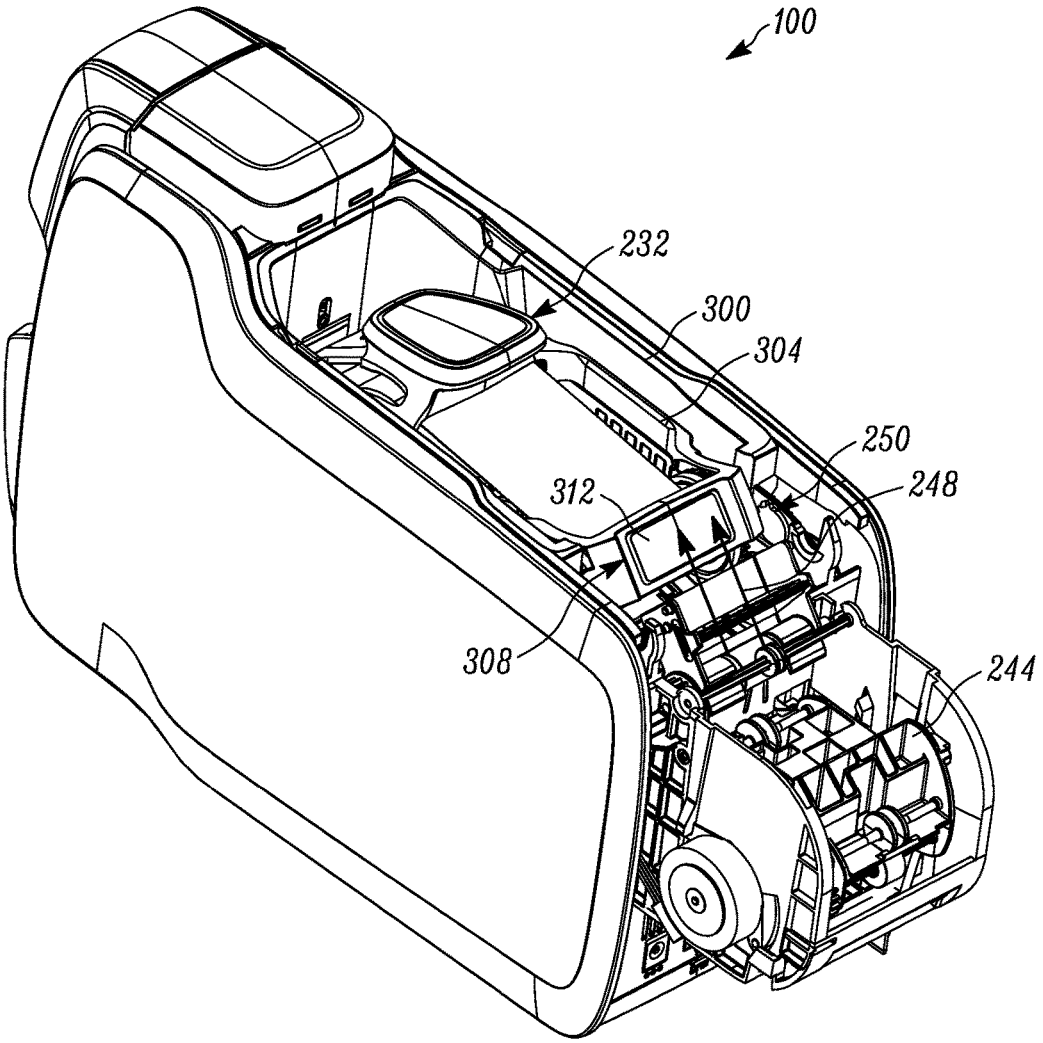
FIG. 3 is a rear perspective view of the media processing device of FIG. 1, with certain portions of the media processing device omitted.

Referring now to FIG. 3, the media processing device 100 is illustrated with certain features thereof omitted. In particular, the door 124 is omitted, revealing an opening 300 in the housing 104 for accessing the cassette 232. Further, the portion of the housing 104 enclosing the redirector 244 is omitted. Together, the omission of the features mentioned above reveals the media unit holder 250. As will be discussed below, the media unit holder 250 is configured to receive a media unit 204 (not shown in FIG. 3) driven along the reject path 248 (e.g., following receipt of the media unit 204 by the redirector 244 and redirection of the media unit 204 to the reject path 248 instead of the return portion of the media processing path 216). More specifically, the media unit holder 250 is configured to receive the media unit 204 between the opening 300 and a body 304 of the cassette 232.

The media unit holder 250 includes a deck 308 with a support surface 312. The support surface 312 is disposed between the cassette body 304 and the opening 300, and faces the opening 300 (when the cassette 232 is installed in the media processing device 100). In other words, the support surface 312 is oriented in the direction of the opening 300, instead of, for example, the interior of the media processing device 100 (e.g. the media processing path 216). The deck 308 is configured to receive the rejected media unit 204 on the support surface 312, for storing the rejected media unit 204 on the support surface 312 until removal of the rejected media unit 204 via the opening 300.

Figure 4:
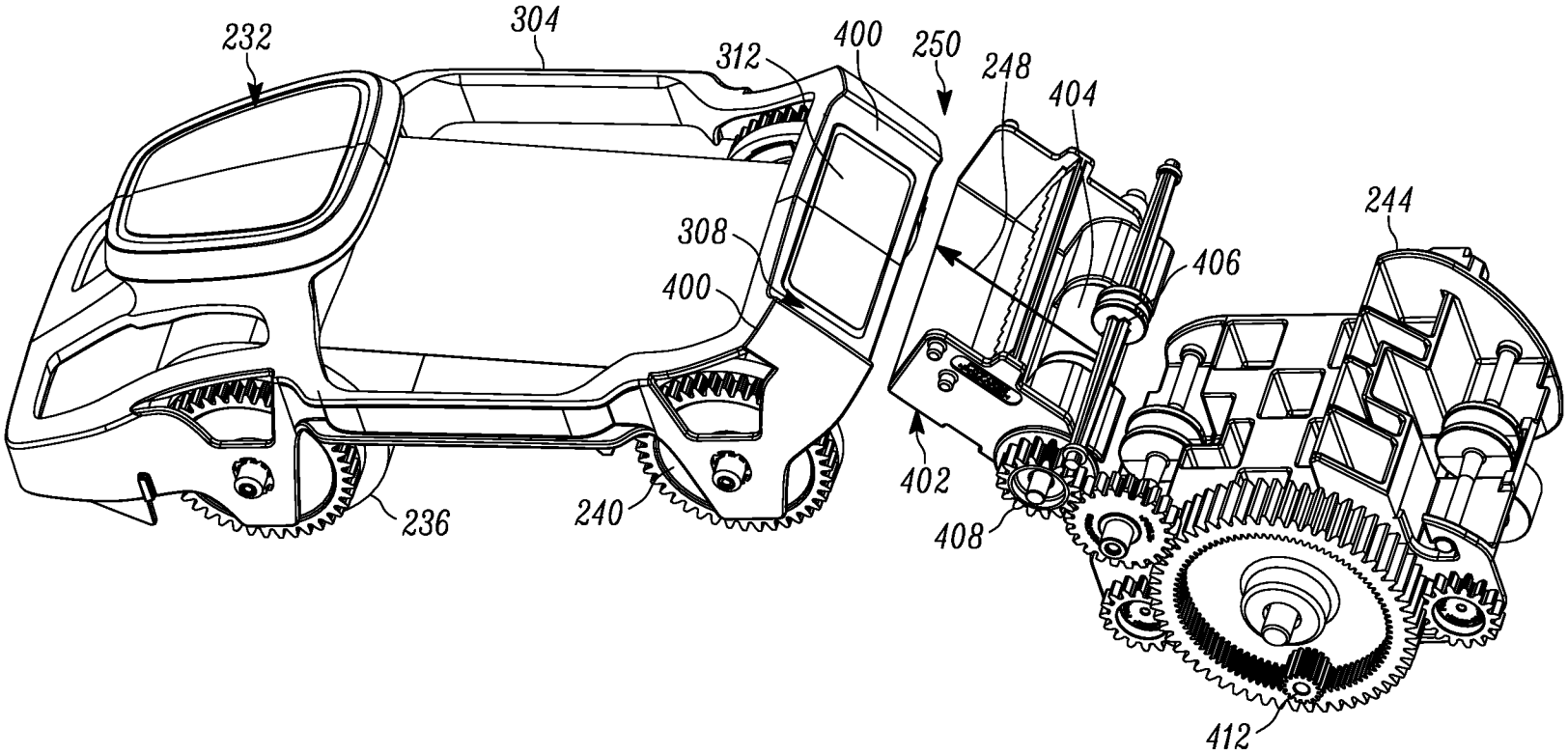
FIG. 4 depicts a ribbon cassette, a media unit holder, and a media unit redirector of the media processing device of FIG. 1.

Turning to FIG. 4, the cassette 232, the media unit holder 250 and the redirector 244 are shown in isolation from the remainder of the media processing device 100. In the illustrated example, the deck 308 is coupled to the body 304 of the cassette 232. More particularly, in some examples (including that illustrated in FIG. 4) the deck 308 is integrally formed with the body 304 of the cassette 232. In other words, the deck 308 is a portion of the body 304, and the support surface 312 is therefore an outer surface of the body 304. In other examples, however, the deck 308 and the support surface 312 need not be integrally formed with the body 304. In some examples, the deck 308 is a distinct component mounted between the body 304 and the opening 300.

In the illustrated example, the deck 308 includes at least one side wall in addition to the support surface 312. A pair of side walls 400 are illustrated in FIG. 4, extending from the support surface 312 toward the opening 300 (not shown in FIG. 4). As will be apparent, the side walls 400 also extend toward the reject path 248. The side walls 400 are substantially parallel to the direction of travel of a media unit 204 along the reject path 248, and may serve to center a media unit 204 received along the reject path 248 on the support surface 312, and to inhibit lateral motion (e.g., motion along the support surface 312 in a direction perpendicular to the reject path 248) of the media unit 204 upon receipt. In the illustrated example, the side walls 400 have a height, measured from the support surface 312, equal to at least the thickness of one media unit 204. In other examples, however, each side wall 400 has a height that is smaller than the thickness of one media unit 204. In further examples, one or both of the side walls 400 are omitted.

The media holder 250 also includes a second deck 402, as will be described in greater detail below. The media holder 250 further includes a roller 404, which in the present example is supported by the second deck 402, configured to drive the media unit 204 along the reject path 248 toward the support surface 312. The roller 404 forms a nip with a complementary roller 406 to grasp and drive a media unit 204. In other examples, the roller 406 can be omitted and the roller 404 can be configured to engage the media unit 204 with teeth interlocking with apertures in the media unit 204 or other suitable engagement mechanisms.

The roller 404, in the present example, is fixed to a shaft having a drive wheel such as a gear 408 mounted thereon. The gear 408 is connected, via a drive train (a gear train, in the present example) on the redirector 244, to a pinion 412 driven by a motor (not shown). Rotation of the pinion 412 driven by the motor operates the redirector 244 to either rotate within the housing or to accept or expel a media unit 204 previously received therein. In either event, the gear 408 is driven by the above-mentioned gear train. In the illustrated example, the pinion 412 is driven in opposite directions to select the function of the redirector (e.g., whether to flip a media unit, or to receive or expel a media unit). To avoid driving a media unit 204 in reverse on the reject path, the gear 408 is mounted on the shaft carrying the roller 404 via a one-way clutch. In other examples, the gear 408 is replaced with another suitable drive wheel, such as a pulley driven by a belt. In further examples, the gear 408 or any other suitable drive wheel need not be driven by the pinion 412. Instead, in some examples the gear 408 is driven by an additional motor (not shown) distinct from the motor configured to drive the pinion 412.

Figure 5:
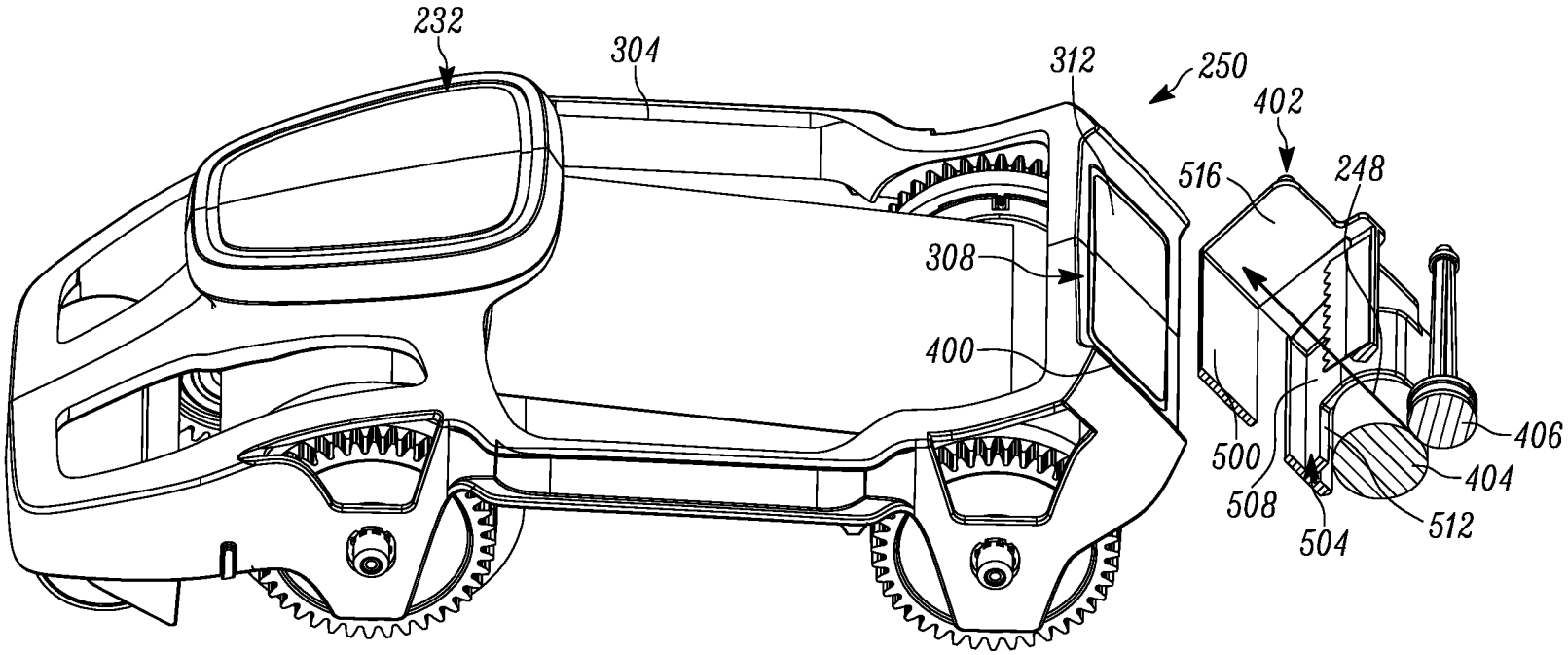
FIG. 5 depicts the cassette and a cross-section of the media unit holder of the media processing device of FIG. 1.

Referring to FIG. 5, the cassette 232 and the media unit holder 250 are shown in isolation from the remainder of the media processing device 100, with the second deck 402 shown in cross-section. The second deck 402 includes a second support surface 500 facing the reject path 248. In the present example, the second support surface 500 is substantially parallel to the support surface 312; as will be discussed below, the second support surface 500 is configured to receive and support a trailing portion of a media unit 204, while the support surface 312 is configured to receive and support a leading portion of the media unit 204. The terms "trailing" and "leading" as employed herein are made with reference to the direction of travel of the media unit 204 along the reject path 248. Accordingly, a leading portion of a media unit 204 traveling along the reject path 248 has traveled further along the reject path 248 in the direction indicated in FIG. 5 than a trailing portion of that media unit 204.

The second deck 402 also includes an end wall 504 extending from the second support surface 500 toward the reject path 248 (e.g., substantially perpendicular to the second support surface 500). As seen in FIG. 5 as well as FIGS. 2-3, the support surfaces 312 and 500 are inclined relative to horizontal when the media processing device 100 is positioned for use. Media units 204 supported on the support surfaces 312 and 500 may therefore tend to slide along the support surfaces 312 and 500 in a direction opposite the direction of travel along the reject path 248. The end wall 504 is configured to abut a trailing edge of any media units 204 in the media unit holder 250 to prevent such retrograde movement, after the media units 204 are driven over the end wall 504 by the roller 404. In other examples, the support surfaces 312 and 500 may be inclined to a lesser degree, or may be horizontal, and the end wall 504 may be omitted.

The end wall 504, in the illustrated example, includes first and second wings (one of which, a wing 508, is illustrated in FIG. 5) separated by a cutout 512 in the end wall 504 within which the roller 404 is mounted. In other examples, the cutout is omitted and the roller 404 is mounted upstream (relative to the reject path 248) of the end wall 504 rather than within the cutout.

The second deck 402 also includes at least one side wall 516. In the illustrated example, the second deck 402 includes a pair of side walls 516 (one shown in FIG. 5) each extending from the second support surface 500 toward the reject path 248. In the present example, the side walls 516 are substantially parallel to the direction of travel of the media unit 204 along the reject path 248, and are also substantially perpendicular to the end wall 504. The side walls 516 serve to inhibit lateral motion of media unit 204 upon receipt on the second support surface 500 (or on a previously received media unit 204 supported on the support surface 500). In other examples, the side walls 516 are omitted.

Figure 6:
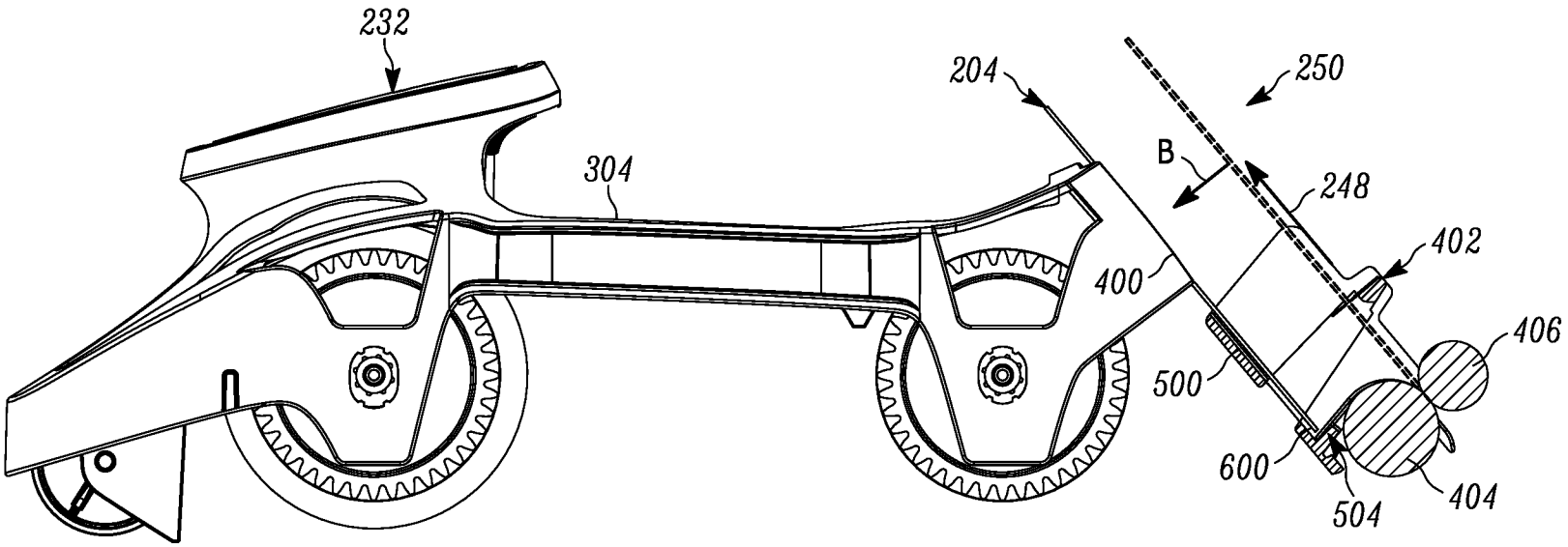
FIG. 6 is a side view of the cassette and the cross-section of the media unit holder shown in FIG. 5.

Turning to FIG. 6, the receipt of a media unit 204 at the media unit holder 250 is illustrated. In particular, the media unit 204, as illustrated in dashed lines, is driven along the reject path 248 by the roller 404, over the end wall 504. When a trailing edge 600 of the media unit 204 clears the end wall 504, the media unit 204 falls in the direction "B" onto the support surfaces 312 (obscured in FIG. 6 by the side wall 400) and 500, or onto a previously received media unit 204. As is evident from FIG. 6, the support surfaces 312 and 500 are spaced apart from the reject path 248 (e.g., in a direction perpendicular to the reject path 248) to accommodate a plurality of additional media units 204 between the support surfaces 312 and 500, and the reject media path 248. That is, the media unit holder 250 is configured to receive and support a plurality of media units 204 prior to requiring that the media units 204 be removed from the media unit holder 250.

Figure 7:
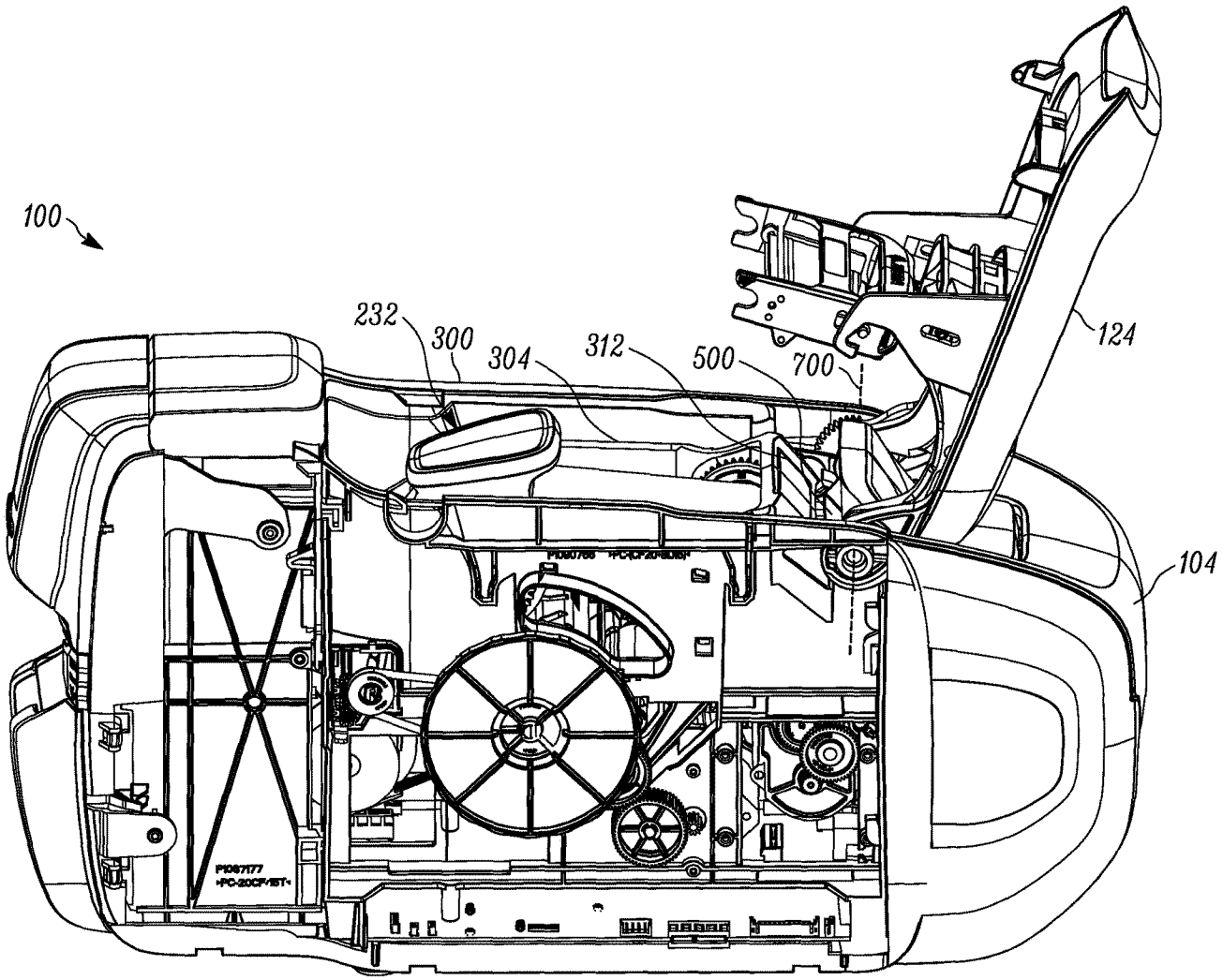
FIG. 7 depicts the media processing device of FIG. 1 with a cassette access door thereof shown in the open position.

The distance between the reject path 248 and the support surfaces 312 and 500 can be selected based on the thickness of the media units 204 processed by the media processing device 100, as well as on the expected rejection rate of the media processing device 100 and the expected capacity of the cassette 232. Referring to FIG. 7, in which the media processing device 100 is illustrated with the door 124 in the open position (e.g., via rotation of the door 124 relative to the housing 104 about an axis 700 adjacent to the second deck 402), the arrangement of the support surfaces 312 and 500 places any media units 204 supported thereon in between the body 304 of the cassette 232 and the opening 300. Accordingly, to remove and replace the cassette 232, the operator of the media processing device 100 is also obliged to remove any rejected media units supported on the support surfaces 312 and 500, which would otherwise obstruct the removal of the cassette 232 via the opening 300. The storage capacity of the media unit holder 250 may therefore be selected to hold the number of rejected media units 204 expected to accumulate during the life of one cassette 232.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A media processing device, comprising:

a housing having an opening to provide access to a cassette removably supported within the housing;

a media unit holder configured to receive a rejected media unit driven between the opening and a body of the cassette along a media reject path, the media unit holder including:

a first deck having a first support surface between the body of the cassette and the opening, the first support surface facing the opening; and a second deck mounted within the housing and having a second support surface, the media unit holder configured to receive the rejected media unit to support (i) a leading portion of the rejected media unit on the first deck, and (ii) a trailing portion of the rejected media unit on the second deck, wherein the first and second decks are configured to receive the rejected media unit for removal of the rejected media unit via the opening.

2. The media processing device of claim 1, wherein the first deck is coupled to the body of the cassette.

3. The media processing device of claim 1, wherein the first deck is integrally formed with the body of the cassette.

4. The media processing device of claim 1, the first deck further comprising a side wall extending from the first support surface toward the opening.

5. The media processing device of claim 4, wherein the side wall is substantially parallel with the reject path.

6. The media processing device of claim 1, the second support surface being substantially parallel with the first support surface.

7. The media processing device of claim 1, the second deck further comprising a side wall extending from the second support surface toward the reject media path.

8. The media processing device of claim 7, wherein the side wall is substantially parallel to the reject media path.

9. The media processing device of claim 7, the second deck further comprising an end wall extending from the second support surface toward the reject media path to abut the trailing edge of the reject media unit following receipt of the reject media unit on the second support surface.

10. The media processing device of claim 9, wherein the end wall is substantially perpendicular to the side wall.

11. The media processing device of claim 9, the media unit holder further comprising a roller configured to drive the rejected media unit over the end wall for receipt on the first support surface and the second support surface.

12. The media processing device of claim 11, the end wall having first and second wings separated by a cutout, the roller mounted within the cutout.

13. The media processing device of claim 1, the first support surface spaced apart from the reject media path to accommodate a plurality of additional reject media units between the first support surface and the reject media path.

14. The media processing device of claim 1, further comprising a door having (i) an open position for permitting access to the cassette and the media unit holder via the opening, and (ii) a closed position for closing the opening.

15. The media processing device of claim 14, wherein the door is mounted to the housing to rotate about an axis adjacent to the second deck.

* * * * *